US005564969A

United States Patent [19]

Tsang

[11] Patent Number: 5,564,969

[45] Date of Patent: Oct. 15, 1996

[54] HAND-HELD POLISHER

[75] Inventor: Koon K. Tsang, Hong Kong, Hong Kong

[73] Assignee: Cliffield Industries Ltd., Hong Kong

[21] Appl. No.: 382,075

[22] Filed: Feb. 1, 1995

[51] Int. Cl.[6] ..... B24B 23/00

[52] U.S. Cl. ..... 451/358; 451/344; 451/359

[58] Field of Search ..... 451/342, 344, 451/358, 359, 294; 279/46.1, 46.2, 102, 906

[56] References Cited

U.S. PATENT DOCUMENTS

| | | | |
|---|---|---|---|
| Re. 33,335 | 9/1990 | Gentischer et al. | 451/342 |
| 3,324,553 | 6/1967 | Borden | 279/906 |
| 3,716,247 | 2/1973 | Sato | 279/906 |
| 4,125,968 | 11/1978 | Mackey | 451/344 |
| 5,235,716 | 8/1993 | Stella | 451/358 |

*Primary Examiner*—D. S. Meislin
*Assistant Examiner*—George Nguyen
*Attorney, Agent, or Firm*—Gunn, Lee & Miller, P.C.

[57] ABSTRACT

A hand-held polisher which comprises a body, an electric motor with a motor shaft held inside the body for driving a polishing implement mounted on the body, and a switch on the body for controlling the operation of the motor. The body has a first part for accommodating a battery cell for electrical connection to the motor under the control of the switch and a second part accommodating the motor. The second body part has a front opening through which the polishing implement is insertable into the body for mounting thereon. A stationary bearing is located in the first body part behind the front opening, in a co-axial position relative thereto, for supporting the polishing implement.

14 Claims, 3 Drawing Sheets

HAND-HELD POLISHER

The present invention relates to a hand-held polisher.

SUMMARY OF THE INVENTION

According to the invention, there is provided a hand-held polisher which comprises a body, an electric motor with a motor shaft held inside the body for driving a polishing implement mounted on the body, and a switch on the body for controlling the operation of the motor, which body has a first part for accommodating a battery cell for electrical connection to the motor under the control of the switch and a second part accommodating the motor, said second part having a front opening through which said polishing implement is insertable into the body for mounting thereon, wherein a stationary bearing is located in the first part of the body behind the front opening, in a substantially co-axial position relative thereto, for supporting said polishing implement.

Preferably, the bearing is located immediately behind the front opening of the body.

In a preferred embodiment, the body includes an internal sleeve member for co-axially locating the bearing in position.

More preferably, the second part of the body has internal ribs for maintaining the sleeve member in the co-axial position.

It is preferred that the bearing has a rear end and is located in position with its rear end fitted co-axially into the tubular member.

In a preferred arrangement, the sleeve member has opposite first and second ends and is located in position with the first end acting co-axially upon innerside of the front opening and the second end bearing co-axially against the motor.

More preferably, the second end of the sleeve member has projections for resiliently bearing against the motor.

In a preferred embodiment, the bearing is of metal.

Conveniently, the bearing is provided by a metal eyelet.

In a preferred configuration, the first part of the body extends laterally from the second part of the body.

BRIEF DESCRIPTION OF DRAWINGS

The invention will now be more particularly described, by way of example only, with reference to the accompanying drawings, in which.

DETAILED DESCRIPTION OF PREFERRED EMBODIMENT(S)

Figure 1:
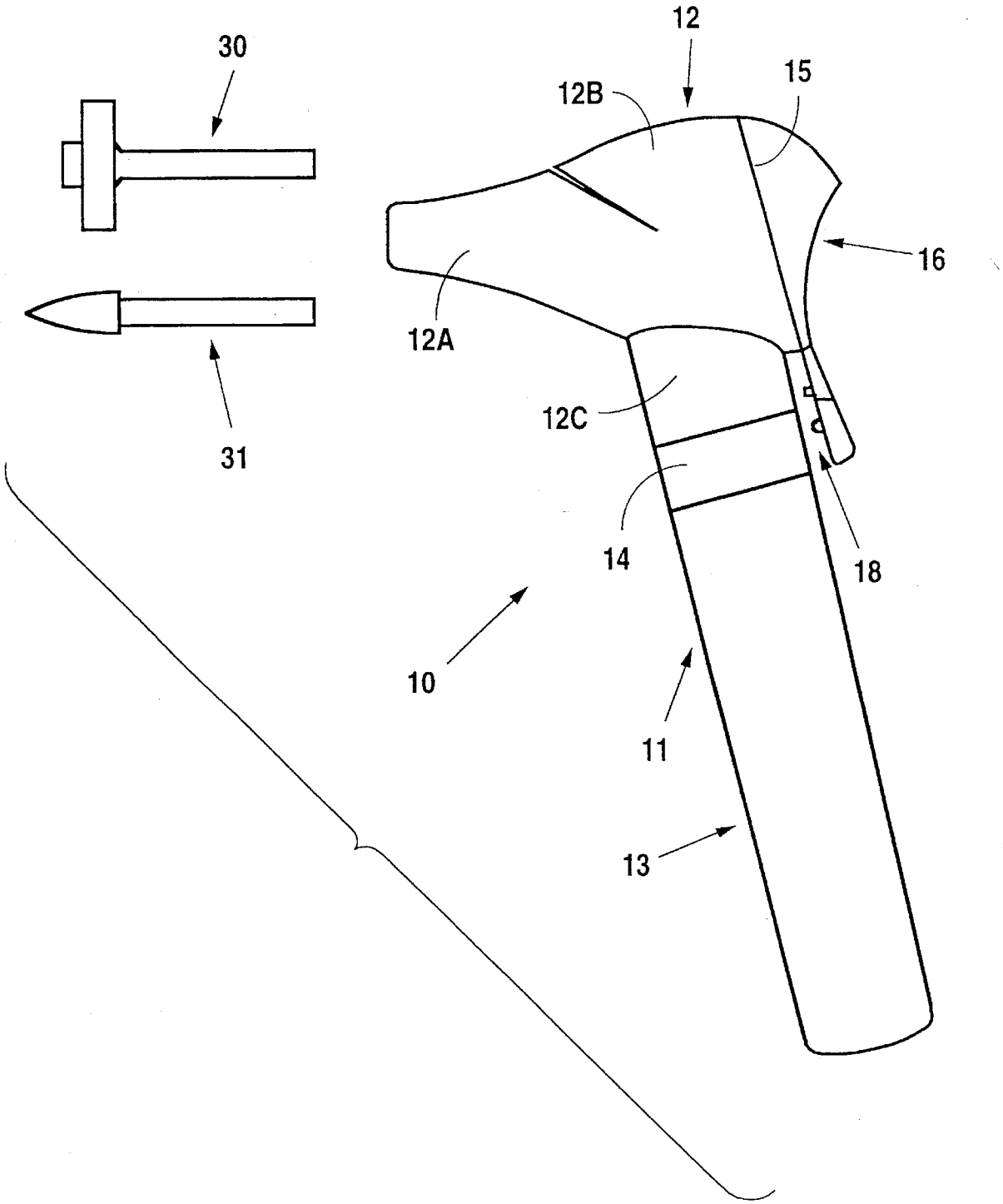
FIG. 1 side view of an embodiment of a hand-held polisher in accordance with the invention, together with first and second polishing implements.
Figure 2:
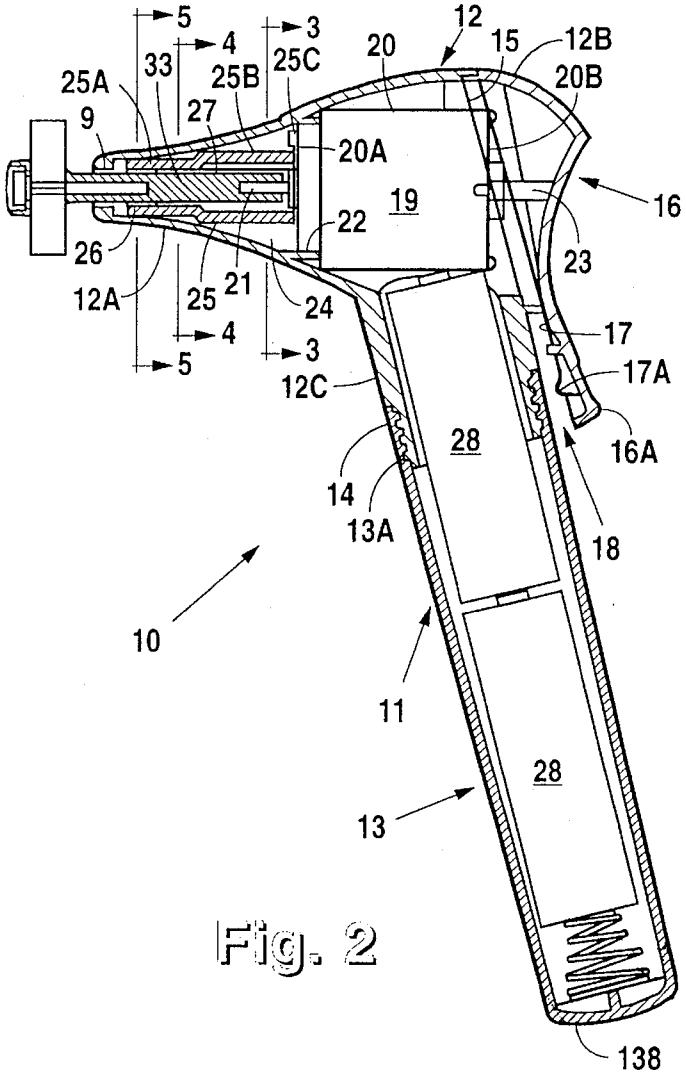
FIG. 2 is a cross-sectional side view of the polisher of FIG. 1, with the first polishing implement mounted.
Figure 3:
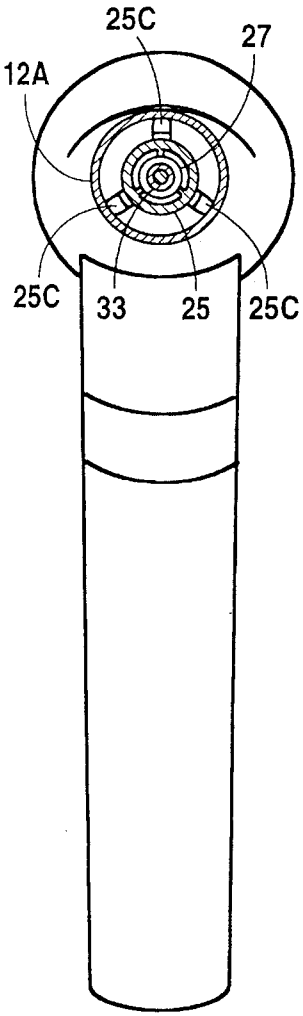
FIG. 3 is a cross-sectional front view of the polisher of FIG. 2, taken along line III—III.
Figure 4:
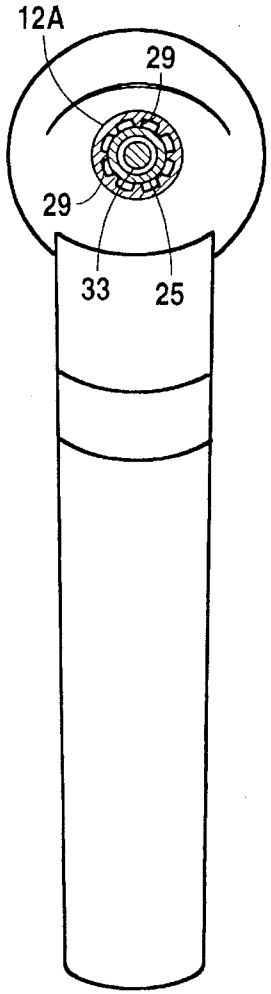
FIG. 4 is a cross-sectional front view of the polisher of FIG. 2, taken along line IV—IV.
Figure 5:
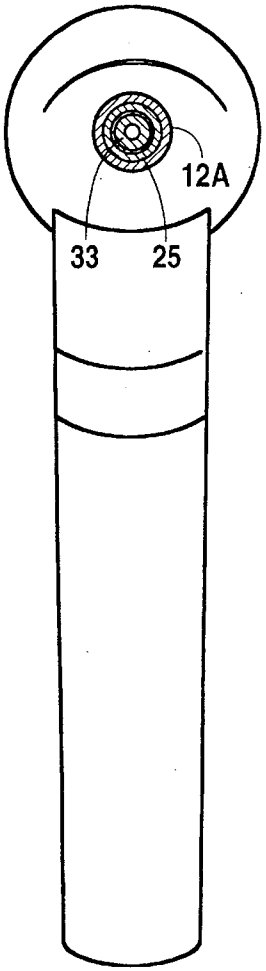
FIG. 5 is a cross-sectional front view of the polisher of FIG. 2, then along view line V—V.
Figure 6:
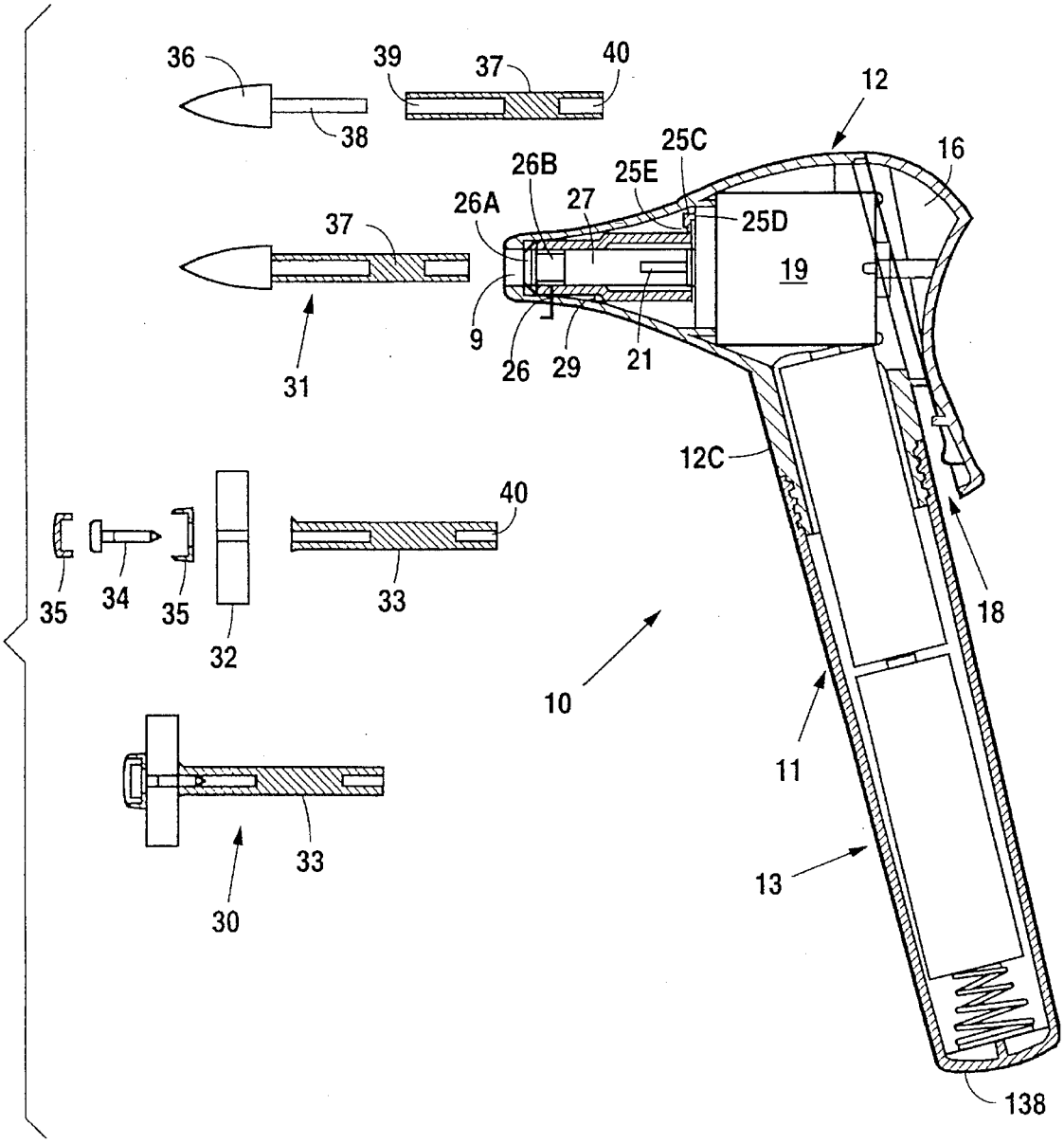
FIG. 6 corresponds to FIG. 1 but is in cross-section, with the first and second polishing implements exploded.

Referring firstly to FIGS. 1 to 5 of the drawings, there is shown a hand-held polisher 10 embodying tile invention, together with two polishing implements 30 and 31, which polisher 10 comprises a plastic body 11 having an upper head 12 and a lower handle 13. The head 12 is generally pear-shaped, having a horizontal axis. The head 12 has a gradually converging front end 12A which terminates forwards at a relatively small circular opening 9, a round rear part 12B, and a cylindrical collar 12C which extends downwards at an angle about 20° backwards. The handle 13 is cylindrical and relatively long, having an open upper end 13A and a closed lower end 13B. The head 12 and handle 13 are releasably connected together through screw-threaded engagement between the head collar 12C and the handle upper end 13A. An electrically-conducting ring 14 is fitted around the handle upper end 13A, at a position just below the head collar 12C.

The rear part 12B of the head 12 has a circular rear opening 15, which lies on a plane substantially parallel to the longitudinal extent of the handle 13. A plastic lid 16 seals the rear opening 15, which has a deflectable tail 16A extending downwards in a direction parallel to the handle 13 and overlying the ring 14 thereon. An electrically-conducting strip 17 is located on the inner side of the tail 16A, which extends upwards into the head rear part 12B. The lowermost end of the strip 17 is bent slightly outwards to form an electrical contact 17A which co-operates with the adjacent ring 14 to form an electrical switch 18. Pressing of the tail 16A will cause the contact 17A to bear against the ring 14, whereby the switch 18 is closed.

The polisher 10 includes a DC electric motor 19 which has a casing 20 having front and rear ends 20A and 20B and a motor shaft 21 extending from the casing front end 20A. The motor 19 is located in a horizontal position inside the rear part 12B of the head 12. A co-axial integral collar 22 is formed inside the head 12, at a position between the head front end 12A and rear part 12B. A pair of integral posts 23 is formed projecting from the inner side of the lid 16. The collar 22 provides a seat for the motor casing front end 20A and the posts 23 bear against the motor casing rear end 20B, whereby the motor 19 is fixed in place.

The motor 19 has a pair of terminals, the first of which is connected to the motor casing 20 and the second one extends to the centre of the motor casing rear end 20B. The strip 17 bears at its upper end against the motor casing rear end, right at and in electrical contact with the second motor terminal. The motor casing 20 is accessible, from below, through the collar 12C of the head 12. The handle 13 serves to hold two battery cells 28 and has a battery connection arrangement in a manner similar to that employed in a conventional electric torch (flashlight). The top end terminal of the upper battery cell 28 extends into the collar 12C and bears at the motor casing 20. The arrangement such that the switch 18 controls the connection of the battery cells 28 to the motor 19, thereby controlling the operation of the motor 19.

The front end 20A of the motor casing 20 closes the front end 12A of the head 12 to define therein a generally conical space 24. The motor shaft 21 extends forwards into this space 24 and is aligned co-axially with the front opening 9 of the head 12. A plastic sleeve 25 is provided horizontally inside the space 24, extending (from rear to front end) between the motor casing front end 20A and the head front opening 9. The sleeve 25 has cylindrical front and rear sections 25A and 25B, the latter being slightly larger in diameter than the former. Three equi-angularly spaced integral feet 25C are formed at the extreme rear end of the sleeve section 25B. A small round projection 25D is formed integrally on the underside of each foot 25C, for bearing against the motor casing front end 20A. Each foot 25C is weakened at its junction 25E with the sleeve section 25B such that it is readily resiliently pivotable about the junction. The innerside of the head 12 has longitudinal-extending integral ribs 29 for ensuring the co-axial orientation of the motor 19 and sleeve 25 with respect to the head 12.

A metal bushing 26, for example conveniently in the form of an unpressed brass eyelet having a circular front flange 26A and a tubular rear end 26B, is fitted co-axially with the rear end 26B into the front end of the sleeve 25. The sleeve 25 serves to support the bushing 26 by urging the bushing flange 26A against the innerside of the opening 9. The resilient feet 25C allow a certain degree of tolerance in the size/dimension of the bushing 26. The sleeve 25 surrounds, co-axially at its rear end, the motor shaft 21 and thus serves also to provide a tubular passage 27 for receiving the polishing implements 30 and 31.

The first polishing implement 30 is a wool-wheel polisher, which is formed by a wool-wheel 32 and a plastic shaft 33. The wool-wheel 32 is secured co-axially to the front end of the shaft 33 by a metal screw 34. The head of the screw 34 is encased by a pair of plastic caps 35, one cupping the other, at a position against the front, side of the wool-wheel 32. The second polishing implement 31 is formed by a pointed conical wool-wheel 36 and a plastic shaft 37. The conical wool-wheel 36 has an integral shaft 38 which is force-fitted co-axially into a blind hole 39 provided at the front end of the other shaft 37 each main shaft 33/37 has at its rear end a co-axial blind hole 40. Each polishing implement 30/31 is to be mounted onto the polisher 10 by its main shaft, 33/37 inserted into the front end 12A of the polisher head 12, through and right down the passage 27 until the shaft end hole 40 engages, as a tight fit, onto the motor shaft 21, In use, the polishing implement 30/31 is almost always subject to a side load bearing the implement shaft 33/37 against the bushing 26 which serves as a stationary bearing. The engagement between the shaft 33/37 and the bushing 26 causes relatively much more wear-and-tear to the shaft 33/37 than to the bushing 26. Sacrifice of the shaft 33/37, to the benefit of the bushing 26, is intended as the polishing implements 33 and 37 are consumable items but not the bushing 26 which is not intended to be replaceable.

It is envisaged that the bushing 26 may not necessarily be of metal, such as porcelain, so long as the material is relatively more wear-resistant than the shaft material of the polishing implements.

The invention has been described by way of example only, and various other modifications of and/or alterations to the described embodiment may be made by persons skilled in the art without departing from the scope of the invention as specified in the appended claims.

What is claimed is:

1. A hand-held polisher comprising:

a body having a first part and a second part;

an electric motor having a motor shaft held inside said second part of said body for driving a polishing implement mounted on said body, said second part having a front opening through which said polishing implement is insertable into said body for mounting thereon;

a switch provided on said body for operating said motor by controlling electrical connection of said motor to a battery cell accommodated within said first part of said body; and a separate stationary bearing located substantially co-axially in said front opening of said second part of said body by means of a substantially co-axial internal sleeve member for supporting said polishing implement, said second part having internal ribs for maintaining said sleeve member in said substantially co-axial position.

2. A hand-held polisher as claimed in claim 1, wherein said bearing is located immediately behind said front opening of said second part of said body.

3. A hand-held polisher as claimed in claim 1, wherein said bearing has a rear end and is located in position by having said rear end fitted co-axially into said sleeve member.

4. A hand-held polisher as claimed in claim 1, wherein said sleeve member has opposite first and second ends and is located in position with said first end acting co-axially upon innerside of said front opening and said second end bearing co-axially against said motor.

5. A hand-held polisher as claimed in claim 4, wherein said second end of said sleeve member has projections for resiliently bearing against said motor.

6. A hand-held polisher as claimed in claim 1, wherein said bearing is of metal.

7. A hand-held polisher as claimed in claim 1, wherein said bearing is of porcelain.

8. A hand-held polisher as claimed in claim 6, wherein said bearing is provided by a hollow metal rivet.

9. A hand-held polisher as claimed in claim 1, wherein said polishing implement has a plastic shaft.

10. A hand-held polisher comprising:

a body having a first part and a second part;

an electric motor having a motor shaft held inside said second part of said body for driving a polishing implement mounted on said body, said second part having a front opening through which said polishing implement is insertable into said body for mounting thereon;

a switch provided on said body for operating said motor by controlling electrical connection of said motor to a battery cell accommodated within said first part of said body; and a separate stationary bearing located substantially co-axially in said front opening of said second part of said body by means of a substantially co-axial internal sleeve member for supporting said polishing implement, said bearing having a rear end and located in position by having said rear end fitted co-axially into said sleeve member.

11. A hand-held polisher comprising:

a body having a first part and a second part;

an electric motor having a motor shaft held inside said second part of said body for driving a polishing implement mounted on said body, said second part having a front opening through which said polishing implement is insertable into said body for mounting thereon;

a switch provided on said body for operating said motor by controlling electrical connection of said motor to a battery cell accommodated within said first part of said body; and a separate stationary bearing located substantially co-axially in said front opening of said second part of said body by means of a substantially co-axial internal sleeve member for supporting said polishing implement, said sleeve member having opposite first and second ends and located in position with said first end acting co-axially upon innerside of said front opening and said second end bearing co-axially against said motor, said second end having projections for resiliently bearing against said motor.

12. A hand-held polisher comprising:

a body having a first part and a second part;

an electric motor having a motor shaft held inside said second part of said body for direct engagement with and driving a shaft of a polishing implement mounted on said body, said second part having a front opening through which said shaft of said polishing implement is insertable into said body;

a switch provided on said body for operating said motor by controlling electrical connection of said motor to a battery cell accommodated within said first part of said body; and a separate stationary bearing located substantially co-axially in said front opening of said second part of said body by means of a substantially co-axial internal sleeve member surrounding said shaft of said polishing implement for supporting said polishing implement, said bearing being of a material which is relatively more-wear-resistant than that of said shaft of said polishing implement.

13. A hand-held polisher as claimed in claim 12, wherein said bearing is located immediately behind said front opening of the second part of said body.

14. A hand-held polisher as claimed in claim 12, wherein said bearing having a rear end and located in position by having said rear end fitted co-axially into said sleeve member.

* * * * *